US006710586B2

(12) United States Patent
Yamamoto

(10) Patent No.: US 6,710,586 B2
(45) Date of Patent: Mar. 23, 2004

(54) BAND GAP REFERENCE VOLTAGE CIRCUIT FOR OUTPUTTING CONSTANT OUTPUT VOLTAGE

(75) Inventor: Kiyoshi Yamamoto, Toyohashi (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/284,361

(22) Filed: Oct. 31, 2002

(65) Prior Publication Data

US 2003/0094933 A1 May 22, 2003

(30) Foreign Application Priority Data

Nov. 22, 2001 (JP) ..... 2001-357453
Nov. 22, 2001 (JP) ..... 2001-357454

(51) Int. Cl.[7] ..... G05F 3/16
(52) U.S. Cl. ..... 323/313
(58) Field of Search ..... 323/312, 313, 323/314; 327/538, 539

(56) References Cited

U.S. PATENT DOCUMENTS 4,396,883 A * 8/1983 Holloway et al. ..... 323/313
5,001,362 A * 3/1991 Tran ..... 327/103
6,111,396 A * 8/2000 Lin et al. ..... 323/313
6,529,411 B2 * 3/2003 Tonda et al. ..... 365/185.18
6,600,302 B2 * 7/2003 Ghozeil et al. ..... 323/313

FOREIGN PATENT DOCUMENTS

| | | |
|---|---|---|
| JP | A-S58-80716 | 5/1983 |
| JP | A-J08-162574 | 6/1996 |
| JP | A-H11-233738 | 8/1999 |

* cited by examiner

*Primary Examiner*—Adolf Berhane
(74) *Attorney, Agent, or Firm*—Posz & Bethards, PLC

(57) ABSTRACT

A band gap reference voltage circuit of the present invention includes a first band gap reference voltage formation portion for outputting a first reference voltage and a second band gap reference voltage formation portion for outputting a second reference voltage. The band gap reference voltage circuit then outputs a higher one of the first and second band gap reference voltage formation portions to output a constant reference voltage. Accordingly, even if one of the output voltages decreases caused by applying any stress for the first and second band gap reference voltage formation portions, the higher voltage is output as an output voltage of the band gap reference voltage circuit.

16 Claims, 11 Drawing Sheets

BAND GAP REFERENCE VOLTAGE CIRCUIT FOR OUTPUTTING CONSTANT OUTPUT VOLTAGE

CROSS REFERENCE TO RELATED APPLICATIONS

This application is based upon and claims the benefit of Japanese Patent Applications No. 2001-357453 filed on Nov. 22, 2001 and No. 2001-357454 filed on Nov. 22, 2001, the contents of which are incorporated herein by reference.

FIELD OF THE INVENTION

The present invention relates to a band gap reference voltage circuit that outputs a constant output voltage.

BACKGROUND OF THE INVENTION

Conventionally, referring to FIG. 12A, a band gap reference voltage circuit J1 is used as a circuit for generating a reference voltage within an IC. For example, the voltage circuit J1 may be formed at a predetermined portion on the IC chip J2. The IC chip 12 is, as shown in FIG. 12B, mounted on and electrically connected to a lead frame 13 via wire 14, and further is encapsulated within molded resin 15 having fillers.

When a semiconductor device encapsulated within molded resin J5 and including the IC chip J2 with the band gap reference voltage circuit J1 is manufactured, an output voltage of the reference voltage circuit J1 decreases due to a change in circuit characteristics. Further, the amount by which the output voltage decreases has been shown to be non-uniform for different samples.

A graph of experimental results is shown in FIG. 13. The output voltage does not change immediately after the IC chip J2 is encapsulated but changes with respect to stress applied to the IC chip J2 as the resin dries.

In this case, the band gap reference voltage circuit J1 cannot be used as the circuit for generating a reference voltage in a semiconductor device in which high accuracy is required.

Generally, electrical properties of the IC chip change when stress is applied to the IC chip. When stress is applied to the band gap reference voltage circuit J1, voltages VBE of transistors (or voltages VF of diodes) thereof decrease, thereby decreasing the output voltage.

Therefore, it is undesirable that any stress is applied to the band gap reference voltage circuit J1. Through experimentation, it has been confirmed that the output voltage of the band gap reference voltage circuit J1 returns a value before being encapsulated if the resin is removed from the IC chip J2, and the output voltage decrease and non-uniformity is generated regardless of a position of the band gap reference voltage circuit J1. These results suggest that stress is applied over the entire area of the IC chip J2 by the resin.

Since fillers in the resin apparently cause the output voltage decrease, a semiconductor device encapsulated within resin having no fillers in which the IC chip J2 including the band gap reference voltage circuit J1 is accommodated is manufactured. As a result, the output voltage of the band gap reference voltage circuit J1 encapsulated within only resin is smaller than that of the band gap reference voltage circuit J1 encapsulated within resin having fillers. The result suggests that the fillers are related to the output voltage decrease and non-uniformity.

For example, the output voltage decrease may be caused by compression stress applied to a surface of the IC chip J2 in a direction perpendicular thereto because many kinds of stresses are concentrically applied due to the fillers touching the surface of the IC chip J2. In addition, sizes of the fillers are not identical, densities of the fillers in the resin are different with respect to position thereof, and a number of the fillers touching the band gap reference voltage circuit J1 depends on a total area of the band gap reference voltage circuit J1. Therefore, the compression stress may vary based on these factors, thereby increasing non-uniformity of the output voltage.

Therefore, the output voltage decrease and non-uniformity can be decreased by removing the fillers from the resin. However, since a thermal expansion coefficient of the resin is higher than that of the IC chip J2 or lead frame J3 if the fillers are removed, the band gap reference voltage circuit J1 cannot be used for technical applications that require a wide operation temperature range.

In the band gap reference voltage circuit J1, it is generally preferable that a constant reference voltage is output even if the atmospheric temperature changes. However, since transistors or the like included in the band gap reference voltage circuit J1 have temperature characteristics, the band gap reference voltage circuit J1 has a quadric factor with respect to temperature. FIG. 14 shows a relationship between temperature and an output voltage of a related band gap reference voltage circuit. The relationship is illustrated by parabolically-shaped curve of FIG. 14. When the band gap reference voltage circuit J1 is applied to, for example, a circuit for forming the reference voltage of a high accuracy power supply, an accuracy of the reference voltage is insufficient due to the quadric factor with respect to temperature, and therefore more accurate reference voltage is required.

SUMMARY OF THE INVENTION

It is therefore an object of the present invention to provide a band gap reference voltage circuit that is capable of obviating the above problem.

It is another object of the present invention to provide a band gap reference voltage circuit that is capable of minimizing output voltage decrease and non-uniformity even if fillers are included in resin.

It is further object of the present invention to provide a band gap reference voltage circuit that is capable of suppressing output voltage variation due to temperature change.

According to a band gap reference voltage circuit of the present invention, a first band gap reference voltage formation portion outputs a first reference voltage. A second band gap reference voltage formation portion outputs a second reference voltage. The band gap reference voltage circuit then outputs a higher one of the first and second reference voltages of the first and second band gap reference voltage formation portions to output a constant reference voltage.

Accordingly, even if one of the first and second reference voltages decreases due to application of stress to the first and second band gap reference voltage formation portions, the higher of the two voltages is output as an output voltage of the band gap reference voltage circuit. As a result, the output voltage of the band gap reference voltage circuit is almost constant, and therefore a band gap reference voltage circuit with low output voltage decrease and non-uniformity can be obtained when it is, for example, encapsulated within resin having fillers.

According to a band gap reference voltage circuit of the present invention, a first level shift circuit shifts a temperature on which the second reference voltage of the second band gap reference voltage formation portion has a maximum value from a temperature on which the first reference voltage of the first band gap reference voltage formation portion has a maximum value.

Accordingly, for example, the band gap reference voltage circuit outputs a first reference voltage of the first band gap reference voltage formation portion as the output voltage in a low temperature range and a second reference voltage of the second band gap reference voltage formation portion as the output voltage in a high temperature range. As a result, the output voltage is formed by a composite voltage of the first and second reference voltages of the first and second band gap reference voltage formation portions in low and high temperature ranges so that the variation of the output voltage is suppressed. Therefore, the output voltage is approximately constant over wide temperature range, and therefore a band gap reference voltage circuit with low variation in output voltage can be obtained even if atmospheric temperature varies.

BRIEF DESCRIPTION OF THE DRAWINGS

Other objects, features and advantages of the present invention will be understood more fully from the following detailed description made with reference to the accompanying drawings. In the drawings.

DETAILED DESCRIPTION OF THE PREFERRED EMBODIMENT

Figure 1:
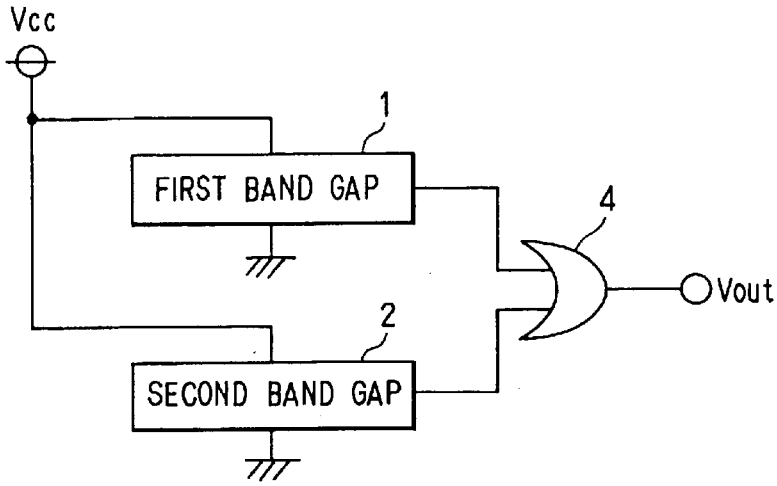
FIG. 1 shows a block diagram of a band gap reference voltage circuit according to a first embodiment of the present invention.

The present invention will be described further with reference to various embodiments shown in the drawings.

(First Embodiment)

Referring FIG. 1, a band gap reference voltage circuit is formed on a surface of an IC chip that is mounted on a lead frame and encapsulated within resin having fillers prior to formation of a semiconductor device.

As shown in FIG. 1, the band gap reference voltage circuit of the present embodiment includes first and second band gap reference voltage formation portions 1, 2 and an OR circuit 4 corresponding to a selecting portion.

The first and second band gap reference voltage formation portions 1, 2 are formed in an identical configuration for generating predetermined voltages as respective first and second output voltages (first and second reference voltages). The first and second output voltages of the first and second band gap reference voltage formation portions 1, 2 are transmitted to the OR circuit 4. As a result, the OR circuit 4 generates an output voltage Vout of the band gap reference voltage circuit.

According to the band gap reference voltage circuit, the OR circuit 4 outputs the higher of the first and second output voltages from the first and second band gap reference voltage formation portions 1, 2. Therefore, even if one of the first and second output voltages decreases due to stress being applied to the first and second band gap reference voltage formation portions 1, 2 by the resin, the higher of two voltages is output by the OR circuit 4 as the output voltage Vout of the band gap reference voltage circuit.

Accordingly, decrease and non-uniformity of output voltage Vout of the band gap reference voltage circuit can be minimized. As a result, the output voltage Vout of the band gap reference voltage circuit is almost constant, and therefore a band gap reference voltage circuit with low output voltage decrease and non-uniformity can be obtained when it is encapsulated within molded resin having fillers.

Incidentally, the OR circuit 4 may alternatively be removed from the band gap reference voltage circuit if the higher of the first and second output voltages from the first and second band gap reference voltage formation portions 1, 2 is selected.

Figure 2:
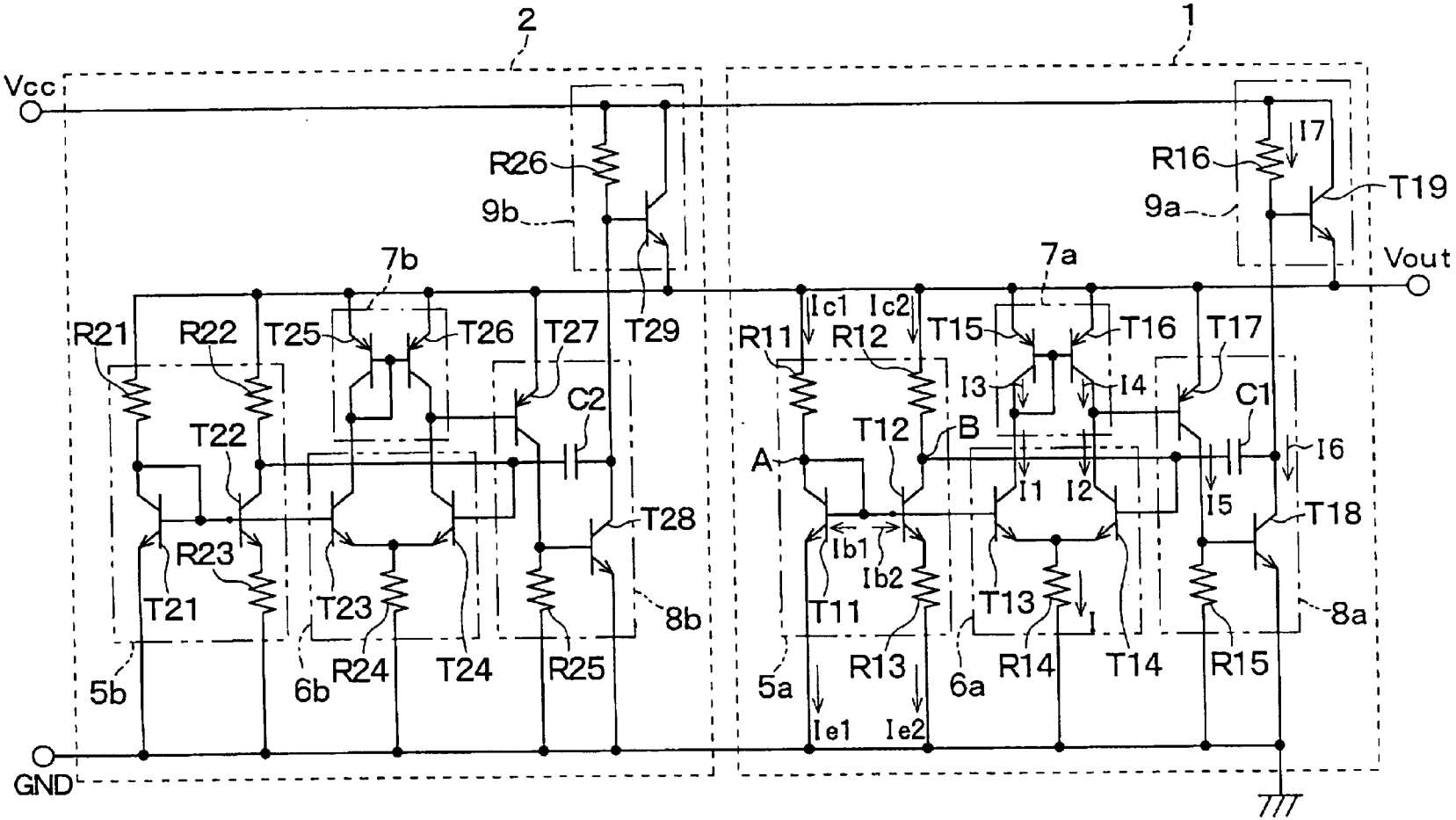
FIG. 2 shows an electrical circuit diagram of the band gap reference voltage circuit according to the first embodiment.

FIG. 2 shows a specific example of the band gap reference voltage circuit shown in FIG. 1. In the band gap reference voltage circuit, an electrical circuit illustrated on a right side of FIG. 2 corresponds to the first band gap reference voltage formation portion 1 and an electrical circuit illustrated on a left side of FIG. 2 corresponds to the second band gap reference voltage formation portion 2. The band gap reference voltage circuit does not include the OR circuit 4 shown in FIG. 1 because the higher of the first and second output voltages from the first and second band gap reference voltage formation portions 1, 2 is selected when it is not included.

The first band gap reference voltage formation portion 1 includes an adjusting portion 5*a*, a differential circuit 6*a*, a current mirror circuit 7*a*, a gain forming portion 8*a* and an emitter follower circuit 9*a*.

The adjusting portion 5*a* includes resistors R11, R12 and transistors T11, T12. The resistor R11 and the transistor T11 are connected in parallel with the resistor R12 and the transistor T12, and respective base electrodes of the transistors T11, T12 are connected with each other. Predetermined density currents different from each other are respectively supplied for respective paths, one of which includes the resistor R11 and the transistor T11 and another one of which includes the resistor R12 and the transistor T12. In this manner, the adjusting portion 5*a* acts to adjust electrical properties of the first band gap reference voltage formation portion 1 with respect to temperature. The transistors T11, T12 correspond to first and second transistors of the present invention.

The differential circuit 6*a* includes transistors T13, T14 and a resistor R14. The transistor T13 inputs a voltage of a connection point (a first potential point) A of the resistor R11 and the transistor T11 as a base voltage. The transistor T14 inputs a voltage of a connection point (a second potential point) B of the resistor R12 and the transistor T12 as a base voltage. The resistor R14 connects to respective emitter electrodes of the transistors T13, T14.

The current mirror circuit 7*a* includes transistors T15, T16 whose base terminals are connected with each other, and operates as a current supply port. Identical current flows through the transistors T15, T16.

The gain forming portion 8*a* includes transistors T17, T18 and a resistor R15. The transistor T17 supplies current to the transistor T14 included in the differential circuit 6*a*. The resistor R15 is connected to the transistor T14 through a series connection. The transistor T18 increases gain by increasing variation of current from the transistor T17.

The emitter follower circuit 9*a* includes a transistor T19 and a resistor R16. The resistor R16 connects between base and collector electrodes of the transistor T19.

The differential circuit 6*a*, the current mirror circuit 7*a*, the gain forming portion 8*a* and the emitter follower circuit 9*a* form an OP amp (a first OP amp). A capacitor C1 prevents the OP amp from oscillating by compensating for a phase of the OP amp.

According to the first band gap reference voltage formation portion 1, the predetermined density currents different from each other are supplied for the respective paths, one of which includes the resistor R11 and the transistor T11 and another one of which includes the resistor R12 and the transistor T12.

The transistor T11 and the transistor T12 are connected with each other at respective base electrodes. Therefore, when collector current and base-emitter voltage of the transistor T11 are respectively defined as Ic1 and VBE11 and those of the transistor T12 are respectively defined as Ic2 and VBE12, the current Ic2 that is to flow to the resistor R13 is defined by the following formula based on voltage differences of base-emitter voltages VBE11, VBE12.

$$Ic2=(VBE11-VBE12)/R13 \quad (1)$$

When the base current and emitter current of the transistor T11 are respectively defined as Ib1 and Ie1 and those of the transistor T12 are respectively defined as Ib2 and Ie2, respective emitter currents Ib1, Ib2 are approximately equal to respective collector currents Ic1, Ic2 because respective base currents Ib1, Ib2 are smaller than respective collector currents Ic1, Ic2 and can therefore be ignored. Accordingly, if the base-emitter voltages VBE11, VBE12 change due to a change in characteristics of the transistors T11, T12, the collector current Ic2 flowing to resistor R13 changes and therefore the relationship of electrical potentials of the connection points A, B changes. The electrical potentials of the connection points A, B are applied to base terminals of the transistors T13, T14 forming the differential circuit 6*a* to feedback the characteristics change of the transistors T11, T12.

When respective collector currents of the transistors T13, T14 are defined as I1 and I2 and current flowing through the resistor R14 connecting collector terminals of the transistors T13, T14 is defined as I, the collector currents I1, I2 basically equal I/2. This is because the transistors T15, T16 respectively connected to the transistors T13, T14 form a current mirror connection and respective collector currents I3, I4 flowing to the transistors T15, T16 are identical.

However, the collector currents I1, I2 of the transistors T13, T14 change when the electrical potentials of the connection points A, B change. Therefore, for example, since the collector currents I1, I2 of the transistors T15, T16 forming the current mirror connection are identical value, a base current of the transistor T17 compensates for deficit current if the current I2 flowing to the transistor T14 becomes larger than I/2. As a result, a collector current I5 of the transistor T17 that flows through the resistor R15 increases, and therefore a collector current I6 of the transistor T18 also increases.

The collector current I6 corresponds to a current I7 flowing to the resistor R16. Accordingly, base and emitter potentials of the transistor T19 decrease as the collector current I6 decreases; that is, the current I7 decreases. As a result, the electrical potentials of the connection points A, B are adjusted, and the output voltage Vout tends to be a constant potential.

The second band gap reference voltage formation portion 2 includes an adjusting portion 5*b*, a differential circuit 6*b*, a current mirror circuit 7*b*, a gain forming portion 8*b* and an emitter follower circuit 9*b*. These respective elements 5*b*, 6*b*, 7*b*, 8*b* and 9*b* are the same configurations as respective elements 5*a*, 6*a*, 7*a*, 8*a* and 9*a* included in the first band gap reference voltage formation portion 1 and operates in a similar manner. Specifically, resistors R21–R26 correspond to the resistors R11–16, transistors T21–T29 correspond to the transistors T11–T19, and capacitor C2 corresponds to the capacitor C1. In the present embodiment, the transistor T21, T22 correspond to third and fourth transistors of the present invention. A connection point of the resistor R21 and the transistor T21 and a connection point of the resistor R22 and the transistor T22 respectively correspond to third and fourth potential points.

According to the band gap reference voltage circuit, the higher of the first and second output voltages from the first and second band gap reference voltage formation portions 1, 2 is output as the output voltage Vout. Therefore, it is possible to obtain the same effect as mentioned above.

(Second Embodiment)

Figure 3:
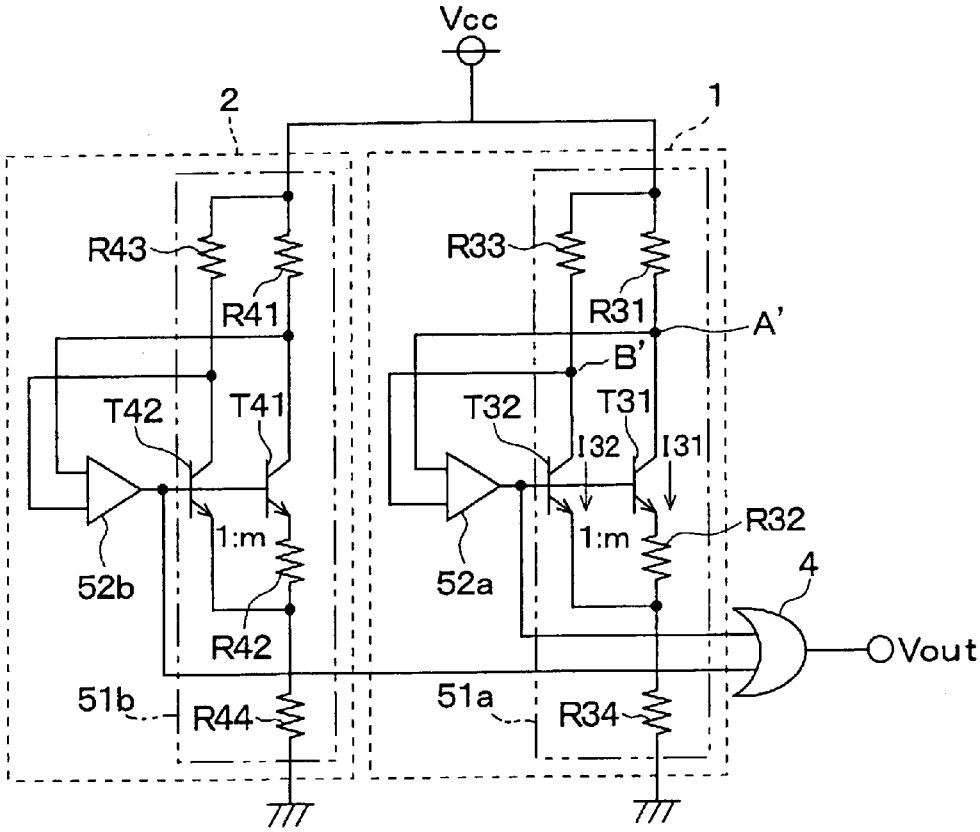
FIG. 3 shows an electrical circuit diagram of a band gap reference voltage circuit according to a second embodiment.

An electrical circuit shown in FIG. 3 may alternatively be adapted for use in the band gap reference voltage circuit shown in FIG. 1 instead of the electrical circuit shown in FIG. 2.

Referring to FIG. 3, a first band gap reference voltage formation portion 1 is formed by an adjusting portion 51*a* and an OP amp (a first OP amp) 52*a*, and a second band gap reference voltage formation portion 2 is also formed by an adjusting portion 51*b* and an OP amp (a second OP amp) 52*b*.

The adjusting portion 51*a* includes resistors R31–R34 and transistors T31, T32. The resistors R31, R32 and the transistor T31 are connected in parallel with the resistor R33 and the transistor T32, and the emitter electrode of the transistor T32 and the electrode of the resistor R32 are connected to the resistor R34. The resistances of the resistors R31, R33 are identical in value. The transistors T31, T32 are respectively formed in first and second predetermined areas. The first predetermined area in which the transistor T31 is formed is larger than the second predetermined area in which the transistor T32 is formed. The OP amp 52*a* inputs a voltage of a connection point (a first potential point) A' of the resistor R31 and the transistor T31 and a voltage of a connection point (a second potential point) B' of the resistor R33 and transistor T32. Then, an output of the OP amp 52*a* is applied to the base terminals of the transistors T31, T32.

According to the first band gap reference voltage formation portion 1, the predetermined density currents different from each other are supplied for the respective paths, one of which includes the resistors R31, R32 and the transistor T31 and another one of which includes the resistor R33 and the transistor T32.

When a current flowing to the resistor R31 and the transistor T31 is defined as I31 and a current flowing to the resistor R33 and the transistor T32 is defined as I32, the currents I31, I32 are identical because the resistances of the resistors R31, R33 are identical. Since the formation area of the transistors T31, T32 is defined as om above-mentioned relationship, the base-emitter voltage VBE32 of the transistor T32 is larger than the base-emitter voltage VBE31 of the transistor T31. Therefore, even if the currents I31, I32 are identical, different density currents respectively flow to the transistors T31, T32.

The electrical potentials of the connection points A', B' are then applied to the OP amp 52*a* to feedback, and therefore base voltages of the transistors T31, T32 are adjusted based on an output of the OP amp 52*a*. For example, if one of the currents I31, I32 is about to increase, the OP amp 52*a* operates to suppress the current increase.

The adjusting portion 51*b* has the same configuration as the adjusting portion 51*a* and operates in a similar manner. Specifically, resistors R41–R44 correspond to the resistors R31–34, transistors T41, T42 correspond to the transistors T31, T32 and OP amp 52*b* corresponds to the OP amp 52*a*. According to the band gap reference voltage circuit, it is possible to obtain the same effect as in the first embodiment.

The transistors T31, T32, T41 and T42 respectively correspond to first to fourth transistors of the present invention. The resistors R34, R44 also respectively correspond to first and second resistors. The connection point of the resistor R41 and the transistor T41 and that of the resistor R42 and the transistor T42 respectively correspond to third and fourth potential points.

(Third Embodiment)

Figure 4:
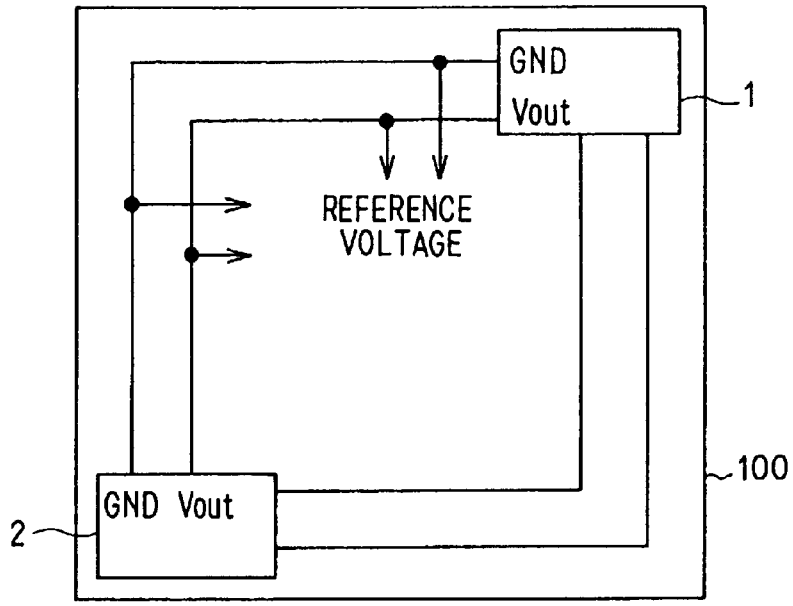
FIG. 4 shows a schematic view of a IC chip on which a band gap reference voltage circuit is formed according to a third embodiment.

FIG. 4 shows a specific layout of first and second reference band gap reference voltage formation portions 1, 2. Referring to FIG. 4, the first and second reference band gap reference voltage formation portions 1, 2 shown in FIGS. 1–3 may alternatively be arranged at different positions on the chip 100. In this manner, if stress varies due to position of the chip 100, it is possible to obtain the same effect as the first embodiment.

(Fourth Embodiment)

Figure 5:
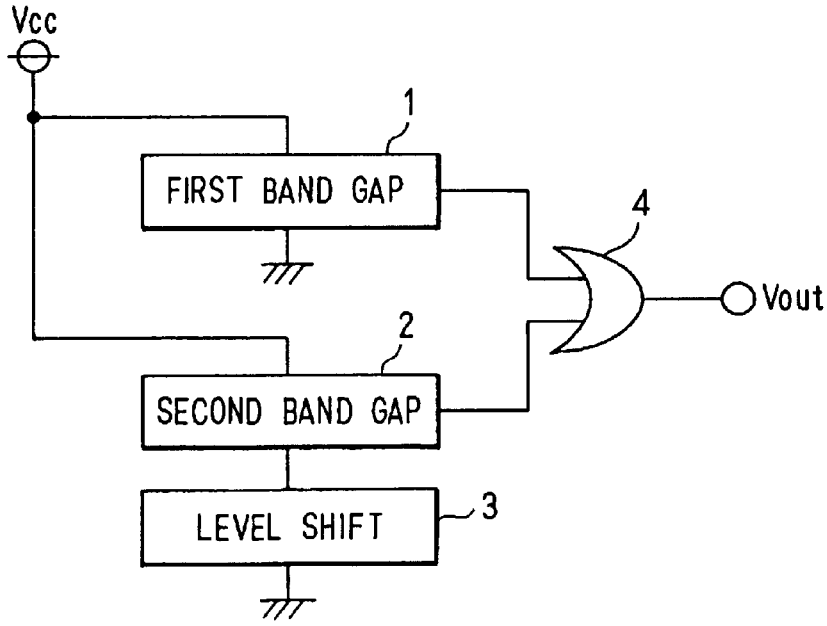
FIG. 5 shows a block diagram of a band gap reference voltage circuit according to a fourth embodiment of the present invention.

Referring to FIG. 5, a band gap reference voltage circuit of a third embodiment includes first and second band gap reference voltage formation portions 1, 2, a level shift circuit 3 and an OR circuit 4 corresponding to a selecting portion.

The first and second band gap reference voltage formation portions 1, 2 are formed in an identical configuration for generating predetermined voltages as respective first and second output voltages (first and second reference voltages). The level shift circuit 3 shifts temperature characteristics of the second output voltage of the second band gap reference voltage formation portion 2. Circuit constants of the band gap reference voltage formation portion 2 and the level shift circuit 3 is appropriately adjusted to shift a temperature on which the second output voltage of the second band gap reference voltage formation portion 2 has a maximum value from a temperature on which the first output voltage of the first band gap reference voltage formation portion 1 has a maximum value. Thus, the circuit constant is, for example, adjusted so that the temperature on which the first output voltage of the first band gap reference voltage formation portion I has a maximum value is in a low temperature range, and the temperature on which the second output voltage of the second band gap reference voltage formation portion 2 is in a high temperature range.

The first and second output voltages of the first and second band gap reference voltage formation portions 1, 2 are transmitted to the OR circuit 4. As a result, the OR circuit 4 outputs a higher of the two voltages output from the first and second band gap reference voltage formation portions 1, 2 as an output voltage Vout of the band gap reference voltage circuit. Therefore, for example, the band gap reference voltage circuit outputs a first output voltage of the first band gap reference voltage formation portion I as the output voltage Vout in a low temperature range and a second output voltage of the second band gap reference voltage formation portion 2 as the output voltage Vout in a high temperature range.

As a result, the output voltage Vout is formed by a composite voltage of the first and second output voltages of the first and second band gap reference voltage formation portions 1, 2 in low room and high room temperature ranges so that the variation of the output voltage Vout is suppressed. Therefore, the output voltage Vout is approximately constant over a wide temperature range, and therefore a band gap reference voltage circuit with low variation of output voltage can be obtained even if atmospheric temperature varies.

Incidentally, the OR circuit 4 may alternatively be removed from the band gap reference voltage circuit if the higher voltage of both of the first and second output voltages from the first and second band gap reference voltage formation portions 1, 2 is selected when the OR circuit 4 is removed.

Figure 6:
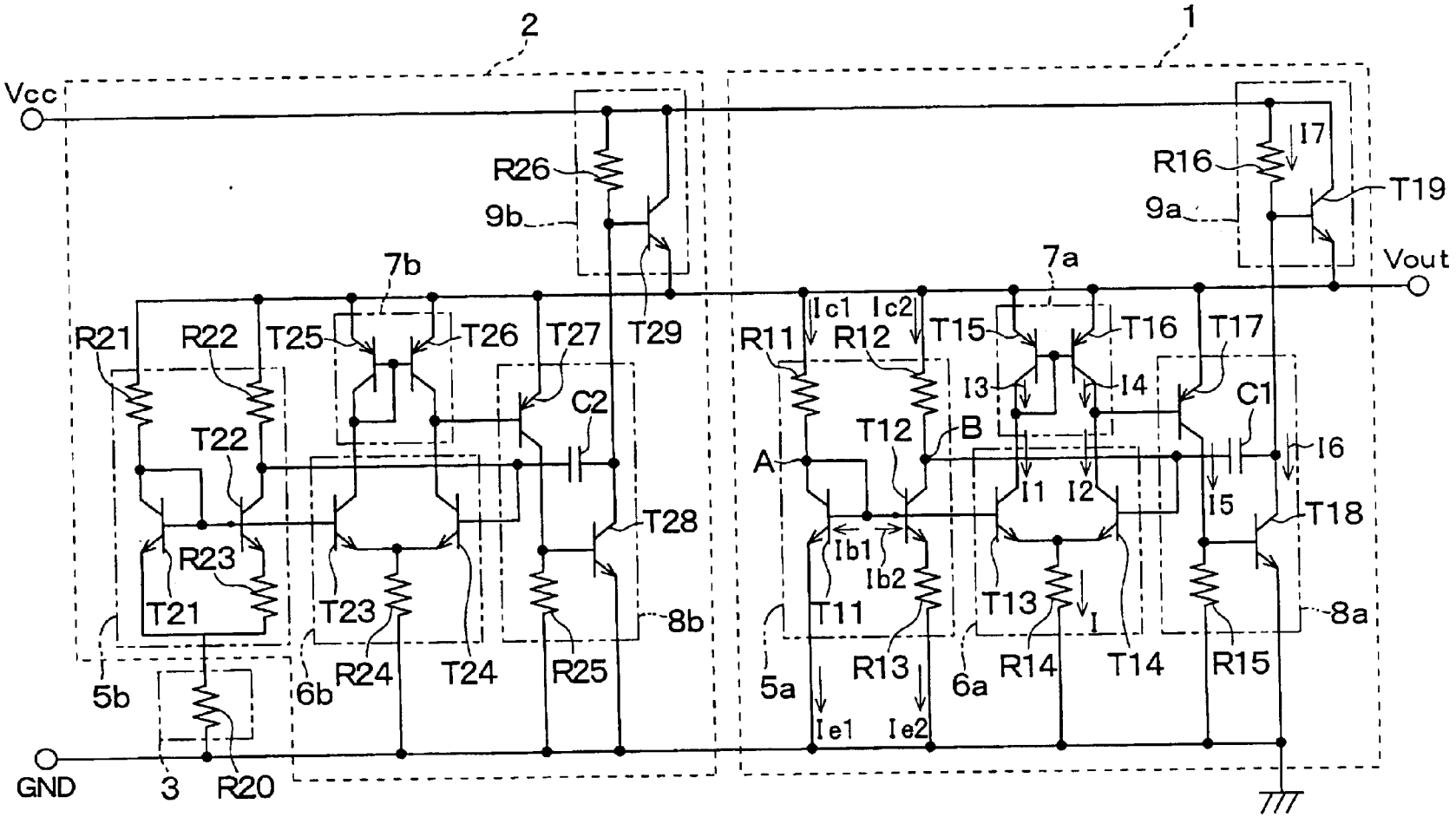
FIG. 6 shows an electrical circuit diagram of the band gap reference voltage circuit according to the fourth embodiment.

FIG. 6 shows a specific example of the band gap reference voltage circuit shown in FIG. 5. The band gap reference voltage circuit has first and second band gap reference voltage formation portions 1, 2 having the same configuration as FIG. 1 of the first embodiment. The first and second band gap reference voltage formation portions 1, 2 basically operate as in the first embodiment.

Further, a resistor R20 corresponding to the level shift circuit 3 is connected to the second band gap reference voltage formation portion 2. The resistor R20 is connected through series connection to a path including a resistor R21 and a transistor T21 and a path including a resistor R22 and a transistor T22, both of which are connected in parallel with each other. The resistor R20 causes output voltage characteristics with respect to temperature of the second band gap reference voltage formation portion 2 shift from that of the first band gap reference voltage formation portion 1.

For example, regarding the band gap reference voltage circuit of FIG. 6, output voltage characteristics with respect to temperature of the first and second band gap reference voltage formation portions 1, 2 are expressed as in following formulae. In the formulae, T corresponds to temperature, k corresponds to Boltzmann constant, q corresponds to electric charge amount, Vout1, Vout2 correspond to the first and second output voltages of the first and second band gap reference voltage formation portions 1, 2, and VBE21 corresponds to base-emitter voltage of the transistor T21.

$$Vout1 = VBE11 + \frac{R12}{R13} \cdot \frac{kT}{q} \cdot \ln\left(\frac{R12}{R11}\right) \quad (2)$$

$$Vout2 = VBE21 + \frac{R22R22 + R21R20 + R22R20}{R21R23} \cdot \frac{kT}{q} \cdot \ln\left(\frac{R22}{R21}\right) \quad (3)$$

The first and second output voltages Vout1, Vout2 of the first and second band gap reference voltage formation portions 1, 2 vary as temperature T varies. However, each constant multiplied by temperature T is a different value so that respective temperatures T on which the first and second output voltages Vout1, Vout2 have a maximum value are different from each other.

Figure 7A:
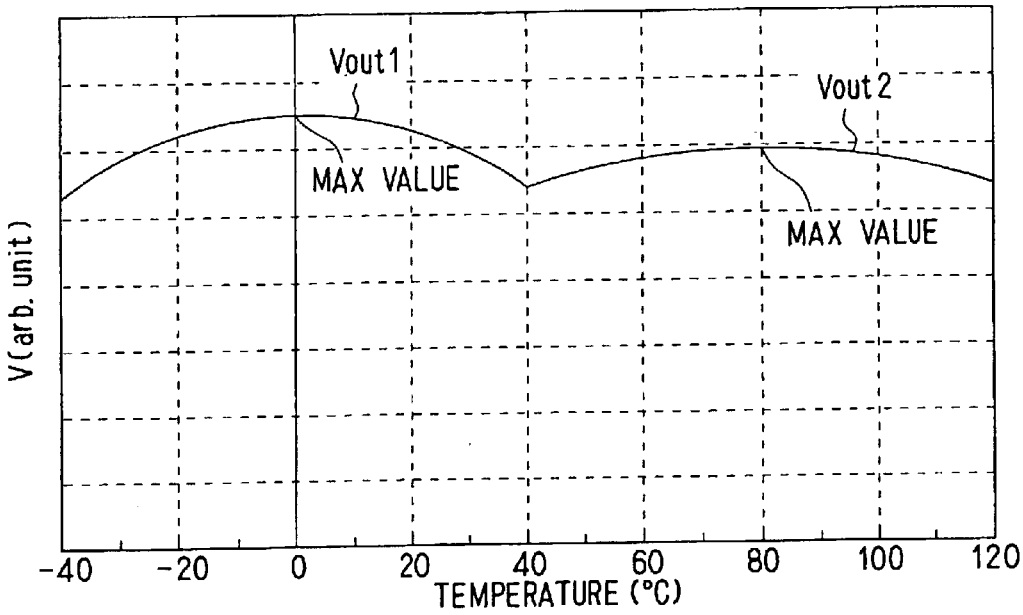
FIGS. 7A and 7B show relationships between temperature and output voltages according to the fourth embodiment.
Figure 7B:
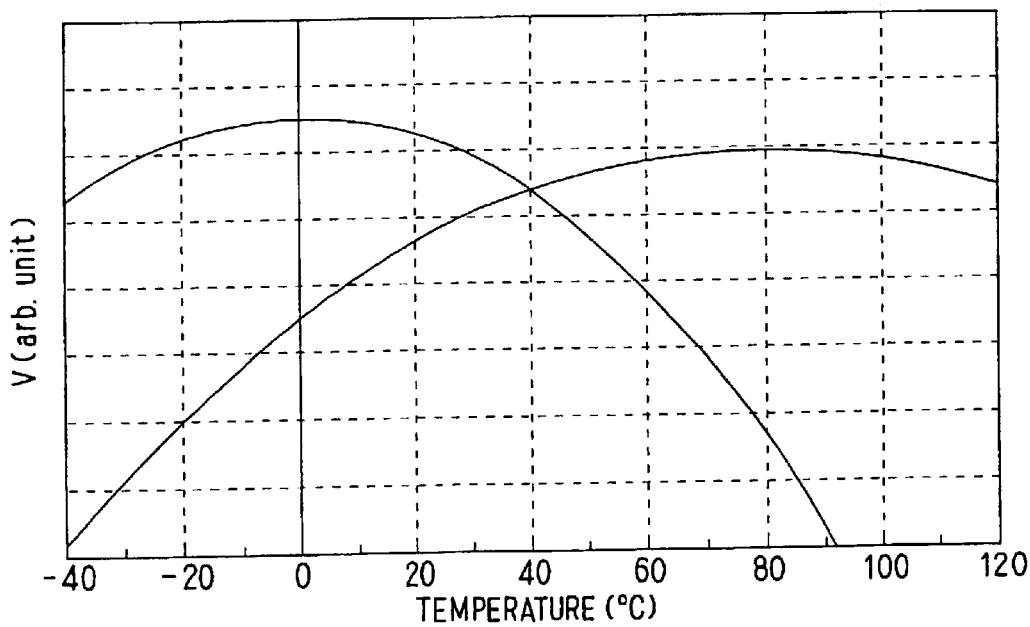

Output voltage characteristics with respect to temperature of the band gap reference voltage circuit investigated by simulation is illustrated in FIG. 7A that correspond to a composition of first and second output voltages of the first and second band gap reference voltage formation portions 1, 2. The simulation results also show that the output voltage characteristics with respect to temperature of the second band gap reference voltage formation portion 2 shifts from that of the first band gap reference voltage formation portion 1. Because higher voltage of the first and second band gap reference voltage formation portions 1, 2 is output as the output voltage Vout, the variation of the output voltage Vout is suppressed in low and high temperature ranges as shown in FIG. 7A.

(Fifth Embodiment)

Figure 8:
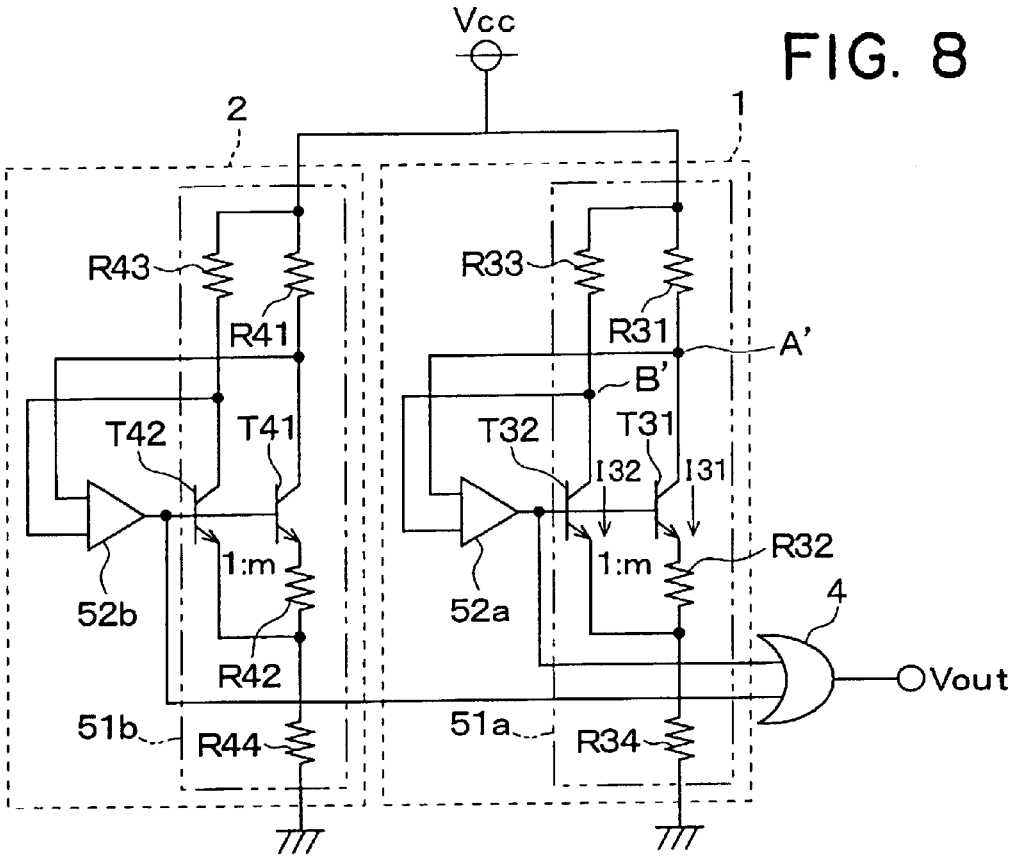
FIG. 8 shows an electrical circuit diagram of the band gap reference voltage circuit according to a fifth embodiment.

An electrical circuit shown in FIG. 8 may alternatively be adapted to the band gap reference voltage circuit shown in FIG. 5 instead of the electrical circuit shown in FIG. 6.

Referring to FIG. 8, a first band gap reference voltage formation portion 1 is formed by an adjusting portion 51*a* and an OP amp (a first OP amp) 52*a*, and a second band gap reference voltage formation portion 2 is also formed by an adjusting portion 51*b* and an OP amp (a second OP amp) 52*b*. These are basically the same configuration as in FIG. 3 of the second embodiment and operate in a similar manner.

However, a resistor 44 is formed with a predetermined resistance different from that of a resistor 34 to operate as a level shift circuit 3. As a result, a temperature on which a second output voltage of the band gap reference voltage formation portion 2 is a maximum value is shifted from a temperature on which a first output voltage of the band gap reference voltage formation portion 1 is a maximum value. That is, regarding the band gap reference voltage circuit of FIG. 8, output voltage characteristics with respect to temperature of the first and second band gap reference voltage formation portions 1, 2 are expressed as in the following formulae. In the formulae, VBE42 corresponds to a base-emitter voltage of the transistor T42, and m corresponds to an area ratio of transistors T31, T32 to transistors T41, T42.

$$Vout1 = VBE32 + 2 \cdot \frac{R12}{R13} \cdot \frac{kT}{q} \cdot \ln m \quad (4)$$

$$Vout2 = VBE42 + 2 \cdot \frac{R44}{R42} \cdot \frac{kT}{q} \cdot \ln m \quad (5)$$

The first and second output voltages Vout1, Vout2 of the first and second band gap reference voltage formation portions 1, 2 vary as temperature T varies. However, each constant multiplied by temperature T is different value so that respective temperatures T on which the first and second output voltages Vout1, Vout2 have a maximum value are different from each other.

According to the band gap reference voltage circuit, it is possible to obtain the same effect as the fourth embodiment.

(Sixth Embodiment)

Figure 9:
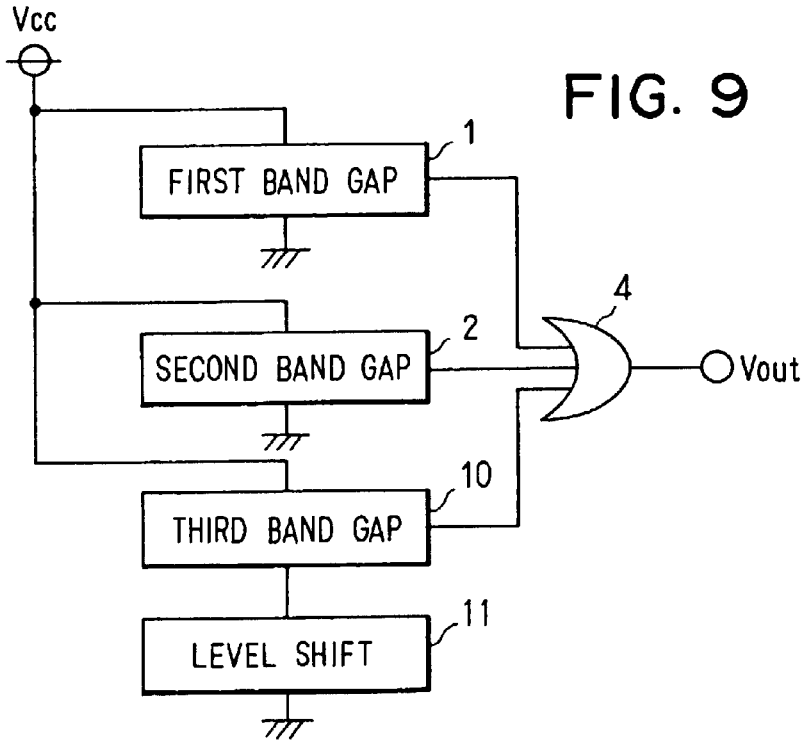
FIG. 9 shows a block diagram of band gap reference voltage circuit according to a sixth embodiment.

Referring to FIG. 9, a band gap reference voltage circuit of a third embodiment includes first to third band gap reference voltage formation portions 1, 2, 10, a level shift circuit 11 and an OR circuit 4 corresponding to a selecting portion.

The third band gap reference voltage formation portion 10 is basically the same configuration as the first and second band gap reference voltage formation portions 1, 2 and generates a predetermined constant voltage as a third output voltage (third reference voltage). The level shift circuit 11 shifts temperature characteristics of the third output voltage of the third band gap reference voltage formation portion 10. Circuit constants of the third band gap reference voltage formation portion 10 and the level shift circuit 11 are appropriately adjusted to shift a temperature on which the third output voltage of the third band gap reference voltage formation portion 10 is a maximum value from a temperature on which the first output voltage of the first band gap reference voltage formation portion 1 is a maximum value. Thus, the circuit constant is, for example, adjusted so that the temperature on which the first output voltage of the first band gap reference voltage formation portion 1 is a maximum value is in a low room temperature range, and the temperature on which the third output voltage of the third band gap reference voltage formation portion 10 is in a high room temperature range.

The first to third output voltages of the first to third band gap reference voltage formation portions 1, 2, 10 are transmitted to the OR circuit 4. As a result, the OR circuit 4 generates a highest one of three output voltages of the first to third band gap reference voltage formation portions 1, 2, 10 as an output voltage Vout of the band gap reference voltage circuit. Therefore, for example, the band gap reference voltage circuit outputs first and second output voltage of the first or second band gap reference voltage formation portions 1, 2 as the output voltage Vout in a low temperature range and a third output voltage of the third band gap reference voltage formation portion 10 as the output voltage Vout in a high temperature range.

As a result, the output voltage Vout is formed by a composite voltage of first to third output voltages of the first to third band gap reference voltage formation portions 1, 2, 10 in low room and high temperature ranges so that the variation of the output voltage Vout is suppressed. Therefore, the output voltage Vout is approximately constant over a wide temperature range, and therefore a band gap reference voltage circuit with low variation in output voltage can be obtained even if atmosphere temperature varies.

Figure 10:
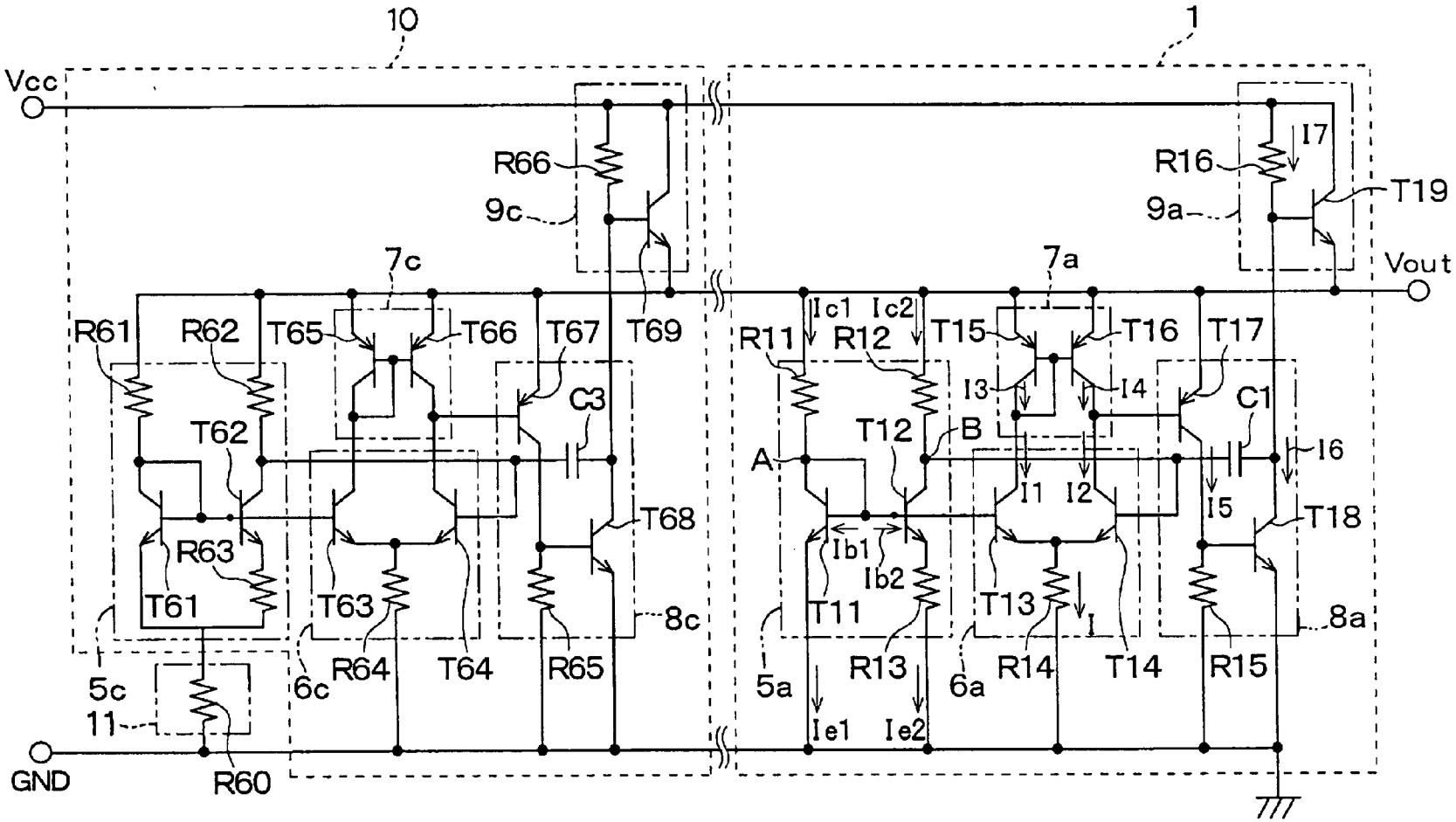
FIG. 10 shows an electrical circuit diagram of the band gap reference voltage circuit according to the sixth embodiment.

FIG. 10 shows a specific example of the band gap reference voltage circuit shown in FIG. 9. In the band gap reference voltage circuit, an electrical circuit illustrated on a right side of FIG. 10 corresponds to the first band gap reference voltage formation portion 1 and an electrical circuit illustrated on a left side of FIG. 10 corresponds to the third band gap reference voltage formation portion 10. In FIG. 10, the second band gap reference voltage formation portion 2 is omitted to simplify the illustration. However, it is actually the same configuration as the first band gap reference voltage formation portion 1 and included between the first and third band gap reference voltage formation portions 1, 10.

The third band gap reference voltage formation portion 10 includes an adjusting portion 5*c*, a differential circuit 6*c*, a current mirror circuit 7*c*, a gain forming portion 8*c* and an emitter follower circuit 9*c*. The differential circuit 6*c*, the current mirror circuit 7*c*, the gain forming portion 8*c* and the emitter follower circuit 9*c* form an OP amp (a third OP amp). A resistor 60 corresponding to the level shift circuit 11 is connected to the third band gap reference voltage formation portion 10.

The respective elements 5*c*, 6*c*, 7*c*, 8*c* and 9*c* are the same configurations as respective elements 5*a*, 5*b*, 6*a*, 6*b*, 7*a*, 7*b*, 8*a* 8*b*, 9*a* and 9*b* included in the first and second band gap reference voltage formation portions 1, 2 and operate in a similar manner. Specifically, resistors R61–R66 correspond to the resistors R11–16 and R21–R26, transistors T61–T69 correspond to the transistors T11–T19 and T31–T39, and capacitor C3 corresponds to the capacitors C1 and C1.

The resistor R60 is connected with a series connection to a path including a resistor R61 and a transistor T61 and a path including a resistor R62 and a transistor T62, both of which are connected in parallel with each other. The resistor R60 causes output voltage characteristics with respect to temperature of the third band gap reference voltage formation portion 3 shift from that of the first and second band gap reference voltage formation portions 1, 2.

According to the band gap reference voltage circuit, it is possible to obtain the same effect as the first and fourth embodiments.

Figure 11A:
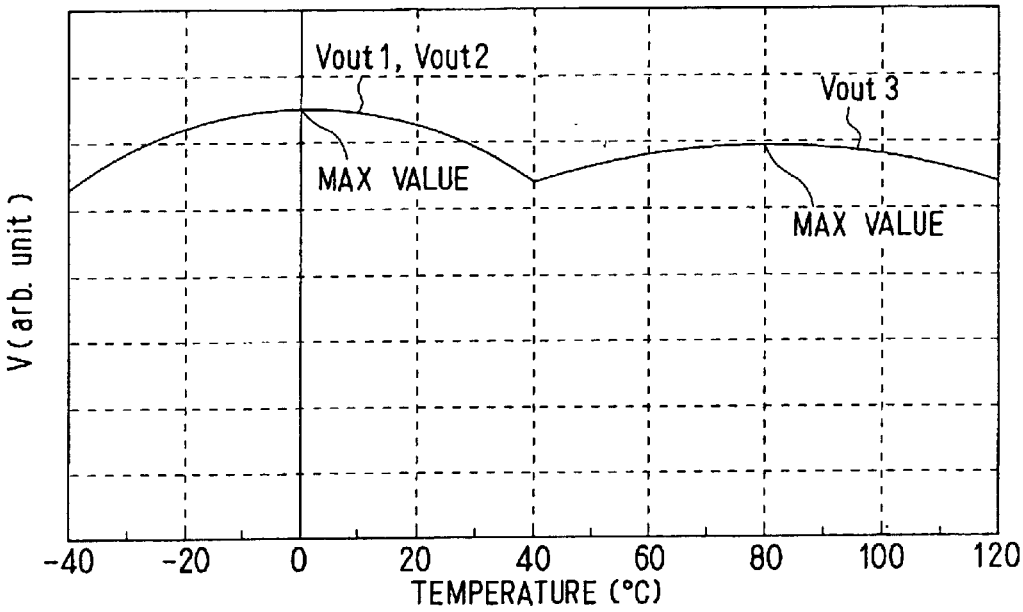
FIGS. 11A and 11B show relationships between temperature and output voltages according to the sixth embodiment.
Figure 11B:
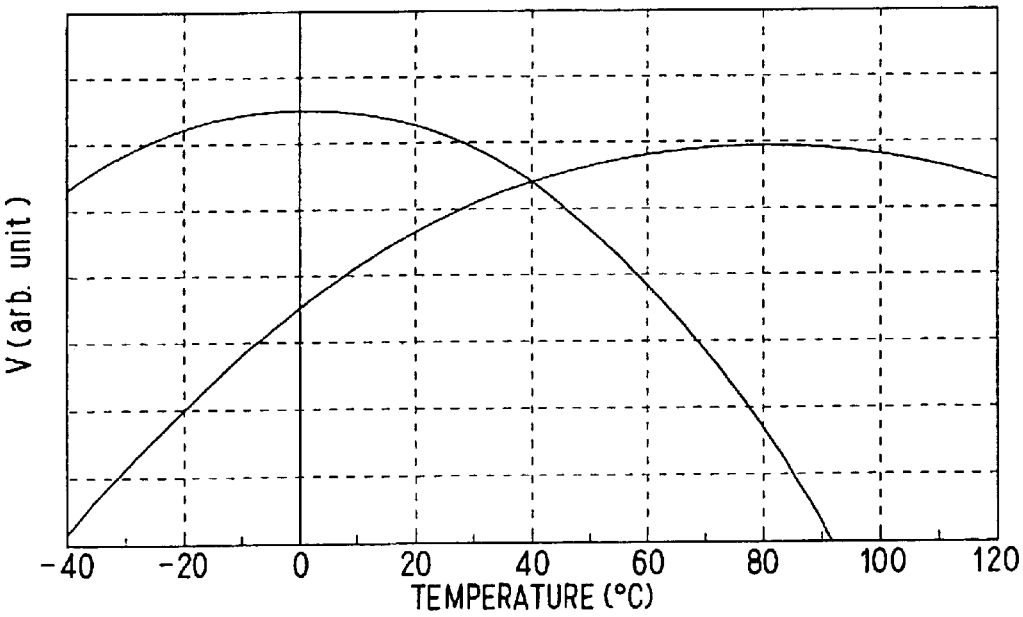
Figure 12A:
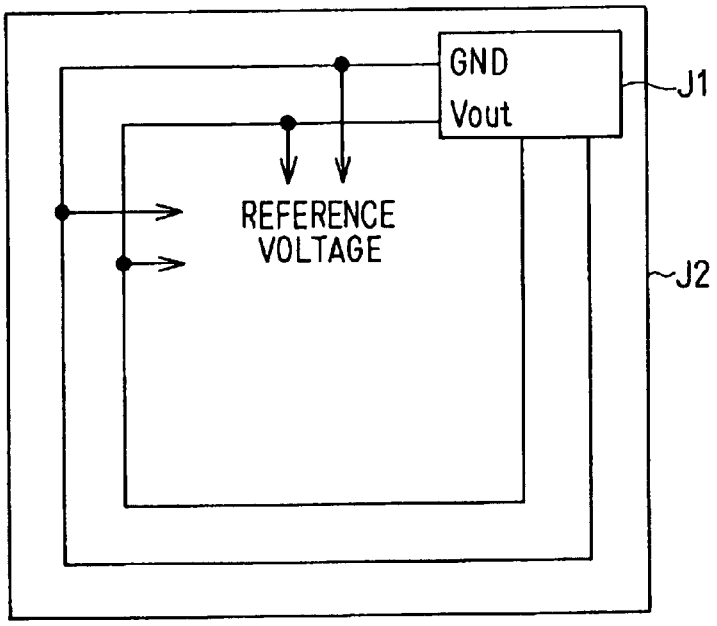
FIG. 12A RELATED ART
FIG. 12A shows a schematic view of a IC chip on which a band gap reference voltage circuit is formed according to the related band gap reference voltage circuit.
Figure 12B:
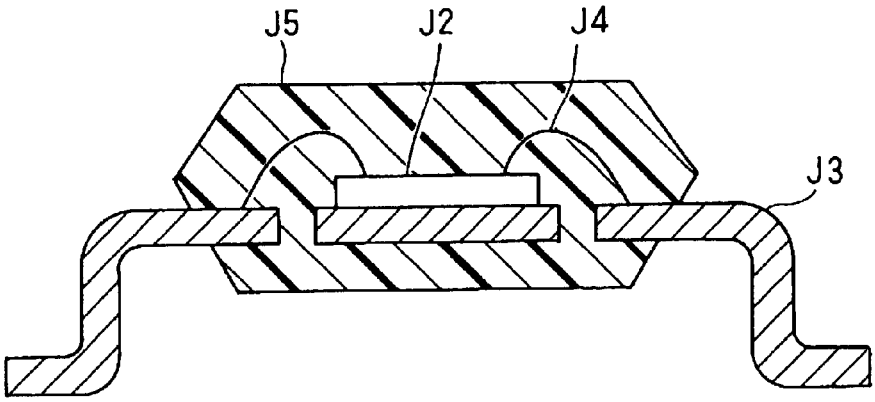
FIG. 12B RELATED ART
FIG. 12B shows a cross sectional view of a band gap reference voltage circuit encapsulated within molded resin having fillers according to the related band gap reference voltage circuit.
Figure 13:
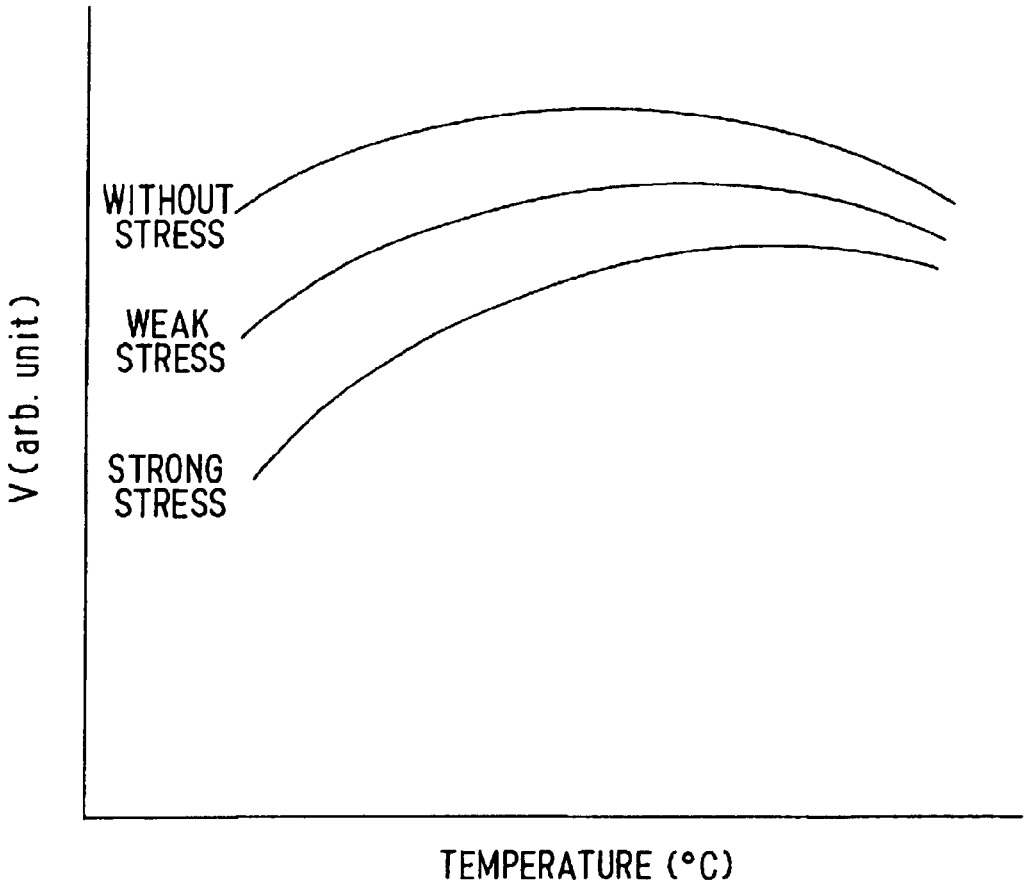
FIG. 13 RELATED ART
FIG. 13 shows relationship between temperature and output voltage with respect to stress strength according to the related band gap reference voltage circuit.
Figure 14:
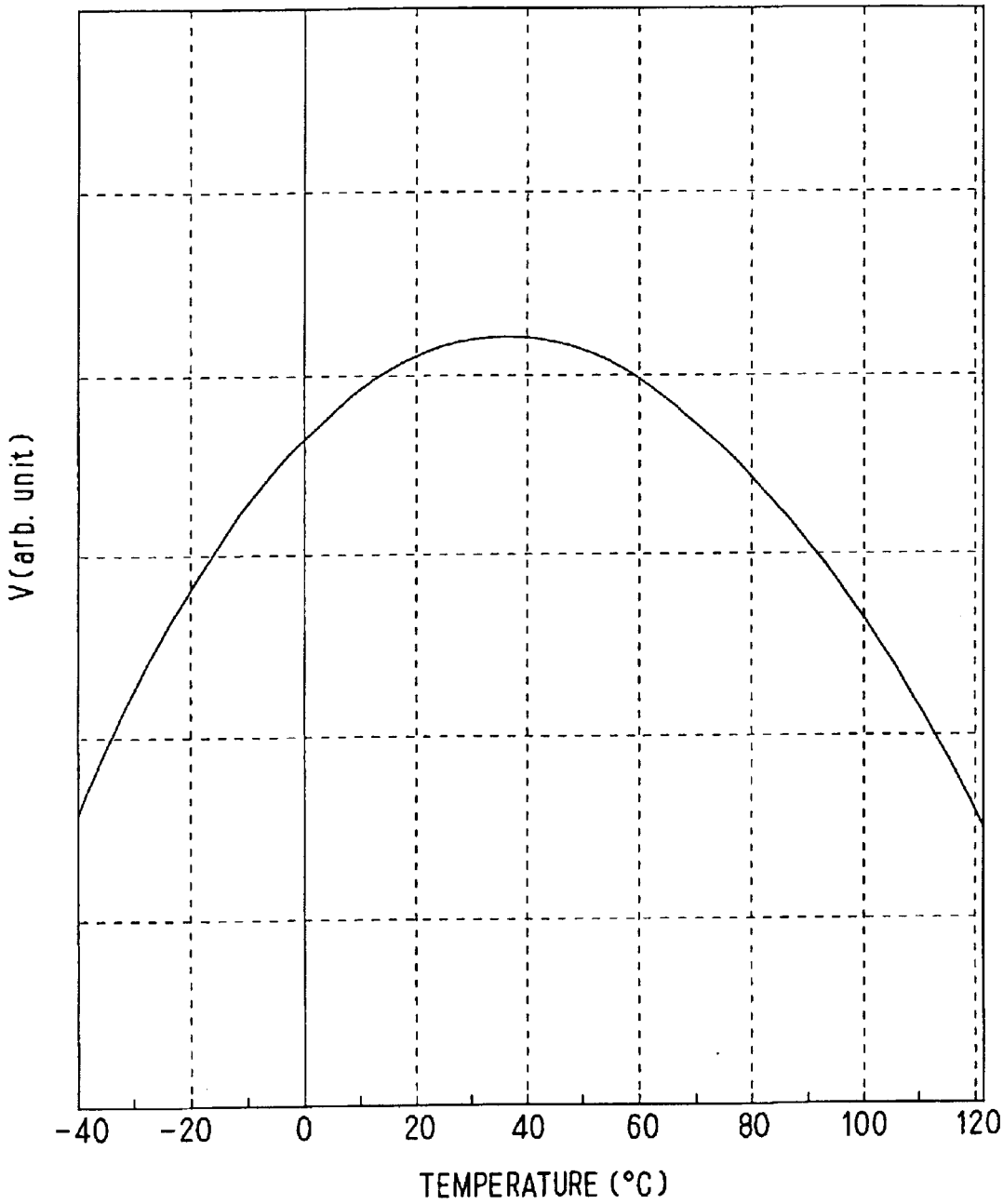
FIG. 14 RELATED ART
FIG. 14 shows relationships between temperature and output voltages according to a related band gap reference voltage circuit.

Output voltage characteristics with respect to temperature of the band gap reference voltage circuit investigated by simulation is illustrated in FIG. 11A that correspond to composition of first to third output voltages (Vout1–Vout3) of the first to third band gap reference voltage formation portions 1, 2, 10. The simulation results also show that the output voltage characteristics with respect to temperature of the third band gap reference voltage formation portion 10 shifts from that of the first and second band gap reference voltage formation portions 1, 2. Because a highest one of three output voltages of the first to third band gap reference voltage formation portions 1, 2, 10 is output as the output voltage Vout, the variation of the output voltage Vout is suppressed in low and high temperature ranges as shown in FIG. 11A.

(Modification)

In the first to sixth embodiments, constitutions illustrated in FIGS. 2, 3, 6, 8 and 10 are explained as the band gap reference voltage circuit, but other public band gap reference voltage circuits may alternatively be adapted for use in the present invention.

In the second and fifth embodiments, the resistances of the resistors R31, R32 are identical to make the currents I31, I32 become identical. This may alternatively be realized by using a current mirror circuit.

In the sixth embodiment, when a fourth band gap reference voltage formation portion and a second level shift circuit that are the same configuration as the third band gap reference voltage formation portion and the level shift circuit are included in the band gap reference voltage circuit, it is possible to obtain the same effect as the first embodiment in a shifted temperature range.

The band gap reference voltage formation portion illustrated in FIG. 8 may alternatively be adapted to the band gap reference voltage circuit of the sixth embodiment. In this case, the band gap reference voltage circuit includes the first and second band gap reference voltage formation portions 1, 2 and a third band gap reference voltage formation portion having the same configuration as the first and second band gap reference voltage formation portions 1, 2 except a resistance of the resistor R44. By adjusting the resistance of the resistor R44, output voltage characteristics with respect to temperature of the third band gap reference voltage formation portion 10 shift from that of the first and second band gap reference voltage formation portions 1, 2.

Further, in the first to third embodiments, the band gap reference voltage circuit includes the first and second band gap reference voltage forming portions. However, the band gap reference voltage circuit can include three or more band gap reference voltage forming portions. In the sixth embodiment, the band gap reference voltage circuit includes the third band gap reference voltage formation portion 10 and the level shift circuit but can include two or more band gap reference voltage formation portions and level shift circuits. In the fourth and fifth embodiments, the band gap reference voltage circuit can include three or more band gap reference voltage formation portions and the level shift circuits.

While the above description is of the preferred embodiments of the present invention, it should be appreciated that the invention may be modified, altered, or varied without deviating from the scope and fair meaning of the following claims.

What is claimed is:

1. A band gap reference voltage circuit for outputting constant reference voltage comprising:

a first band gap reference voltage formation portion for outputting a first reference voltage, and a second band gap reference voltage formation portion for outputting a second reference voltage, wherein the band gap reference voltage circuit is for outputting a higher one of the first and second reference voltages output from the first and second band gap reference voltage formation portions to output a constant reference voltage.

2. The band gap reference voltage circuit according to claim 1, further comprising:

a selecting portion for selecting a higher one of the first and second reference voltages of the first and second band gap reference voltage formation portions to output the constant reference voltage.

3. The band gap reference voltage circuit according to claim 1, wherein the first band gap reference voltage formation portion includes first and second transistors through which respective density currents flow, first and second points at which respective electric potentials vary based on the respective density currents, and a first OP amp for inputting the respective electric potentials at the first and second points and for outputting the first reference voltage, wherein the respective density currents flowing in the first and second transistors are adjusted based on the first reference voltage of the first OP amp, and the second band gap reference voltage formation portion includes third and fourth transistors through which respective density currents flow, third and fourth points at which respective electric potentials vary based on the respective density currents, and a second OP amp for inputting the respective electric potentials at the third and fourth points and for outputting the second reference voltage, wherein the reference density currents flowing in the third and fourth transistors are adjusted based on the second reference voltage of the second OP amp.

4. The band gap reference voltage circuit according to claim 1, wherein the first band gap reference voltage formation portion includes first and second transistors through which respective density currents flow, first and second points at which respective electric potentials vary based on the respective density currents, a first OP amp for inputting the respective electric potentials of the first and second points and for outputting the first reference voltage, and a first resistor connecting to the first and second transistors in a series connection, wherein the respective density currents flowing in the first and second transistors are adjusted based on the first reference voltage of the first OP amp, and the second band gap reference voltage formation portion includes third and fourth transistors through which different density currents flow, third and fourth points at which respective electric potentials vary based on the respective density currents, a second OP amp for inputting the respective electric potentials of the third and fourth points and for outputting the second reference voltage, and a first resistor connecting to the third and fourth transistors in a series connection, wherein the respective density currents flowing in the third and fourth transistors are adjusted based on the second reference voltage of the second OP amp.

5. The band gap reference voltage circuit according to claim 1, further comprising:

a third band gap reference voltage formation portion for outputting a third reference voltage, and a first level shift circuit for shifting a temperature on which the third reference voltage of the third band gap reference voltage formation portion has a maximum value from a temperature on which the first and second reference voltages of the first and second band gap reference voltage formation portions have maximum values, wherein the band gap reference voltage circuit outputting a highest one of the first, second and third reference voltages of the first to third band gap reference voltage formation portions to output the constant reference voltage.

6. The band gap reference voltage circuit according to claim 5, further comprising:

a fourth band gap reference voltage formation portion for outputting a fourth reference voltage, and a second level shift circuit for shifting a temperature on which the fourth reference voltage of the fourth band gap reference voltage formation portion has a maximum value from a temperature on which the first and second reference voltages of the first and second band gap reference voltage formation portions are maximum values so as to close the temperature on which the output voltage of the third band gap reference voltage formation portion has maximum value, wherein the band gap reference voltage circuit outputting a highest one of the first, second, third and fourth reference voltages of the first to fourth band gap reference voltage formation portions to output the constant reference voltage.

7. The band gap reference voltage circuit according to claim 1, wherein the first and second band gap reference voltage formation portions are formed at different positions on a IC chip.

8. The band gap reference voltage circuit according to claim 1, wherein the first and second band gap reference voltage formation portions are formed on an IC chip and encapsulated within molded resin having fillers.

9. A band gap reference voltage circuit for outputting constant reference voltage comprising:

a first band gap reference voltage formation portion for outputting a first reference voltage, a second band gap reference voltage formation portion for outputting a second reference voltage, and a first level shift circuit for shifting a temperature on which the second reference voltage of the second band gap reference voltage formation portion has a maximum value from a temperature on which the first reference voltage of the first band gap reference voltage formation portion has a maximum value, wherein the band gap reference voltage circuit is for outputting a higher one of the first and second reference voltages output from the first and second band gap reference voltage formation portions to output a constant reference voltage.

10. The band gap reference voltage circuit according to claim 9, further comprising:

a selecting portion for selecting a higher one of the first and second reference voltages of the first and second band gap reference voltage formation portions to output the constant reference voltage.

11. The band gap reference voltage circuit according to claim 9, wherein the first band gap reference voltage formation portion includes first and second transistors through which respective density currents flow, first and second points at which respective electric potentials vary based on the respective density currents, and a first OP amp for inputting the respective electric potentials at the first and second points and for outputting the first reference voltage, wherein the respective density currents flowing in the first and second transistors are adjusted based on the first reference voltage of the first OP amp, the second band gap reference voltage formation portion includes third and fourth transistors through which respective density currents flow, third and fourth points at which respective electric potentials vary based on the respective density currents, and a second OP amp for inputting the respective electric potentials of the third and fourth points and for outputting the second reference voltage, wherein the respective density currents flowing in the third and fourth transistors are adjusted based on the second reference voltage of the second OP amp, and the level shift circuit includes a resistor connected to the third and fourth transistors in a series connection.

12. The band gap reference voltage circuit according to claim 9, wherein the first band gap reference voltage formation portion includes first and second transistors through which respective density currents flow, first and second points at which respective electric potentials vary based on the respective density currents, a first OP amp for inputting the respective electric potentials at the first and second points and for outputting the first reference voltage, and a first resistor connecting to the first and second transistors in a series connection, wherein the respective density currents flowing in the first and second transistors are adjusted based on the first reference voltage of the first OP amp, the second band gap reference voltage formation portion includes third and fourth transistors through which respective density currents flow, third and fourth points at which respective electric potentials vary based on the respective density currents, a second OP amp for inputting the respective electric potentials at the third and fourth points and for outputting the second reference voltage, and a second resistor connecting to the third and fourth transistors in a series connection, wherein the respective density currents flowing in the third and fourth transistors are adjusted based on the second reference voltage of the second OP amp, and the level shift circuit is also formed by the second resistor, wherein resistance of the second resistor is different from that of the first resistor.

13. The band gap reference voltage circuit according to claim 9, wherein the first and second band gap reference voltage formation portions are formed on an IC chip and encapsulated within molded resin having fillers.

14. A band gap reference voltage circuit for outputting a constant reference voltage comprising:

a plurality of band gap reference voltage formation portions for respectively outputting constant reference voltages, wherein a highest one of the constant reference voltages output by one of the plurality of band gap reference voltage form portions is output as the constant reference voltage.

15. The band gap reference voltage circuit according to claim 14, wherein some of the plurality of band gap reference voltage formation portions are formed at different positions from others of the plurality of band gap reference voltage formation potions on a IC chip.

16. The band gap reference voltage circuit according to claim 14, wherein the plurality of band gap reference voltage formation portions are formed on an IC chip and encapsulated within molded resin having fillers.

* * * * *